US006679419B1

(12) United States Patent
Sarracino

(10) Patent No.: US 6,679,419 B1
(45) Date of Patent: Jan. 20, 2004

(54) MAILBOX

(76) Inventor: Maximo Sarracino, 1876 SW. 11th St., Miami, FL (US) 33135

( * ) Notice: Subject to any disclaimer, the term of this patent is extended or adjusted under 35 U.S.C. 154(b) by 40 days.

(21) Appl. No.: 10/062,945

(22) Filed: Feb. 1, 2002

(51) Int. Cl.[7] ..... B65D 91/00
(52) U.S. Cl. ..... 232/17; 422/186.3; 422/24
(58) Field of Search ..... 232/17, 34; 250/455.11, 250/492.1; 422/186.3, 24; 34/275

(56) References Cited

U.S. PATENT DOCUMENTS

| | | | | | |
|---|---|---|---|---|---|
| 3,571,939 | A | * | 3/1971 | Paul | 34/275 |
| 5,369,892 | A | * | 12/1994 | Dhaemers | 34/275 |
| 5,498,394 | A | * | 3/1996 | Matschke | 422/24 |
| 5,546,678 | A | * | 8/1996 | Dhaemers | 34/275 |
| 6,365,113 | B1 | * | 4/2002 | Roberts | 422/186.3 |
| 6,497,840 | B1 | * | 12/2002 | Palestro et al. | 422/24 |

OTHER PUBLICATIONS

Astro Too Surplus Electronics, The Self–Decontaminating Mailbox (SDM), Dec. 26, 2001.*

* cited by examiner

*Primary Examiner*—William Miller
(74) *Attorney, Agent, or Firm*—Albert Bordas; J. Sanchelima

(57) ABSTRACT

An improved mailbox designed to rid bacteria and other biological germs present in contents. Designed as a mailbox for small-business or home, the mailbox has a housing assembly with an access door. Within the housing is an ultra violet and ozone generating system. At a rear section of the housing assembly is an extractor assembly, which includes an air intake, filtering system, and extraction fan. When the access door is opened, a micro-switch is triggered, activating a timer assembly. For a first predetermined amount of time, the ultra violet and ozone generating system operate to sterilize bacteria and other biological germs present in the contents, while an "unsafe" indicator is illuminated. Once that operation is complete, the extractor assembly operates for a second predetermined time. When the second predetermined time expires, a "safe" indicator illuminates, notifying a user that the contents have been sterilized for a predetermined amount of time.

6 Claims, 3 Drawing Sheets

MAILBOX

II. BACKGROUND OF THE INVENTION

1. Field of the Invention

The present invention relates to a mailbox, and more particularly, to an improved mailbox that rids bacteria and other biological germs present in contents.

2. Description of the Related Art

Many designs for mailboxes have been designed in the past. None of them, however, include a system designed to rid contents of bacteria and biological germs, such as anthrax.

Prior art teaches that Ultra Violet "UV" irradiation and ozone can effectively sterilize bacteria and biological germs.

Designed as a personal mailbox for small-business or home, the instant invention has a housing assembly with an access door. Within the housing is an ozone generating system. At a rear section of the housing assembly is an extractor assembly, which includes an air intake, filtering system, and extraction fan.

When the access door is opened to place contents, a micro-switch is triggered, activating a timer assembly. For a first predetermined amount of time, the ozone generating system operates to sterilize bacteria and other biological germs present in the contents. An "unsafe" indicator illuminates during the operation of the ozone generating system. At the completion of the operation of the ozone generating system, the extractor assembly is activated for a second predetermined time. Once the extraction operation is complete, a "safe" indicator illuminates, notifying a user that the bacteria and biological germs have been sterilized and rid of.

The instant invention protects the user from viruses and bacteria that are be present in contents that are mailed.

There are no mailboxes to the best of applicant's knowledge, which include a housing assembly having an access door, wherein the housing assembly has an ozone generating system and an extractor assembly, and where electronic means notify a user when bacteria and biological germs have been sterilized for a predetermined amount of time from contents mailed.

III. SUMMARY OF THE INVENTION

A mailbox for contents, comprising a housing assembly having an access door, where the housing assembly is substantially hollow. An indicator assembly having electronic means, notifies a user when the contents are free of bacteria and biological germs while in the housing assembly. Ultra violet and ozone generating means radiate the contents within the housing assembly with rays and ozone, to effectively sterilize the bacteria and biological germs existing within the housing assembly. Circulation means circulate sterilized bacteria and biological germs out of the housing assembly.

More specifically, the housing assembly has an access door and first, second, and third walls. The access door and the first wall are in a parallel and spaced-apart relationship with respect to the second and third walls and the second wall has a through-hole. A mounting post may elevate the housing assembly.

The circulation means to circulate sterilized bacteria and biological germs out of the housing assembly comprises an extractor assembly having an air intake, filtering system and extraction fan. The air intake has cooperative dimensions to mount within the housing assembly and specifically onto the through-hole. The filtering system retains the sterilized bacteria and biological germs when the extraction fan is operating.

The electronic means comprises at least one visual indicator that illuminates to notify the user when the bacteria and biological germs have been sterilized for a predetermined time and rid of from the contents.

The bacteria and biological germs as an example can be anthrax.

It is therefore one of the main objects of the present invention to provide a mailbox that rids bacteria and biological germs that may be present in contents.

It is another object of this invention to provide a mailbox that permits a user to safely process contents.

It is another object of the present invention to provide a mailbox with a source of ozone by means of an ultra violet lamp, or other ozone generator, for sterilizing or decontaminating contents.

It is still another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
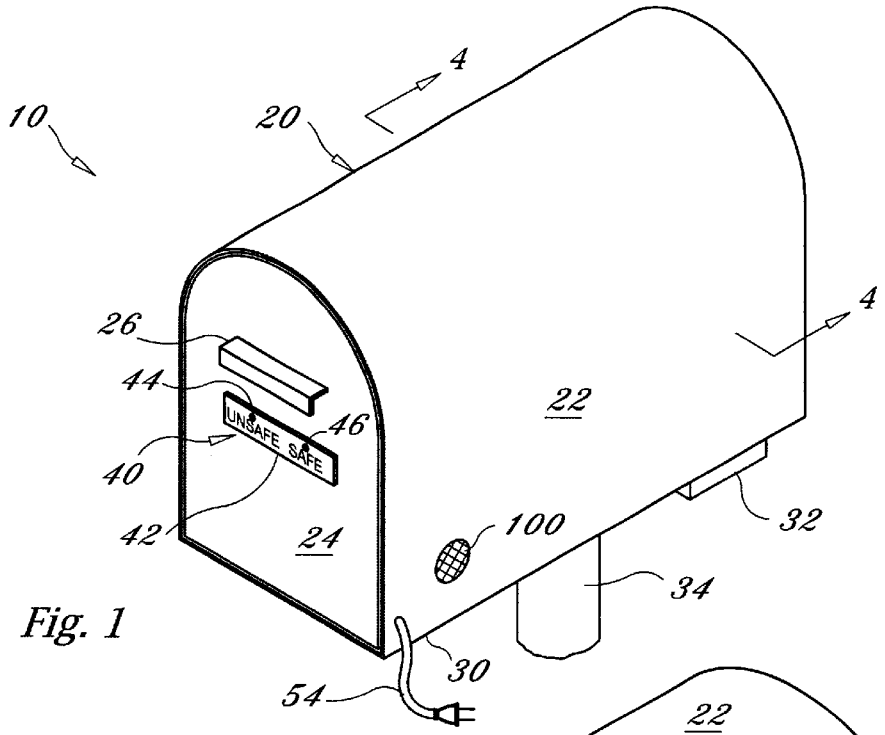
FIG. 1 illustrates a perspective view of the instant invention.

Referring now to the drawings, where the present invention is generally referred to with numeral 10, it can be observed that it basically includes housing assembly 20, indicator assembly 40, ozone producing assembly 60, and extractor assembly 70.

Figure 2:
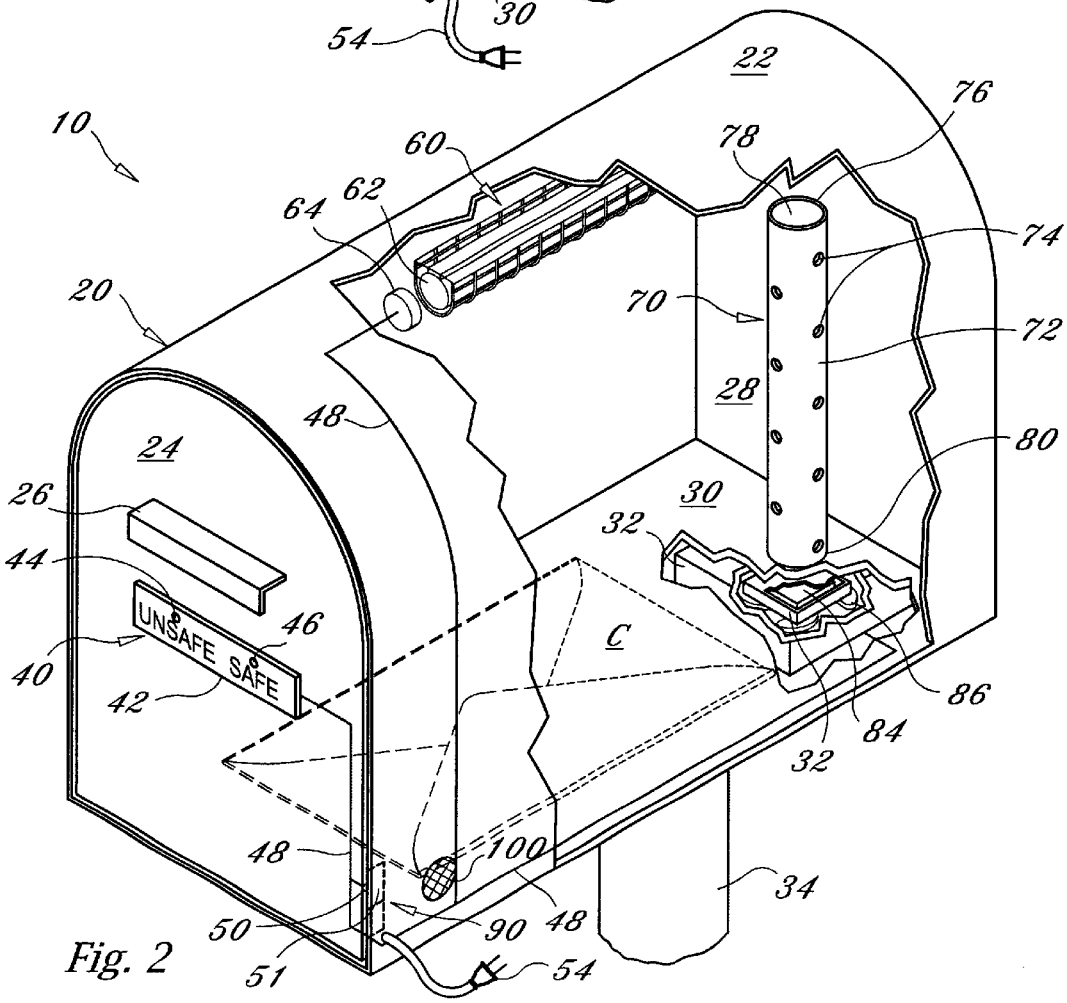
FIG. 2 shows a cut view of the instant invention.

As seen in FIGS. 1 and 2, housing assembly 20 includes wall 22, door 24, rear wall 28, and bottom wall 30. Door 24 and rear wall 28 are in a parallel and spaced-apart relationship with respect to wall 22. In the preferred embodiment, pole 34 is secured onto bottom wall 30 to elevate housing assembly 20 if necessary. Door 24 has handle 26 mounted thereon, to enable a user to place or retrieve contents from housing assembly 20. In the preferred embodiment, door 24 is hingedly mounted at bottom wall 30. Secured onto door 24 is indicator assembly 40. Indicator assembly 40 comprises panel 42, which has illuminating indicators 44 and 46.

Mounted on wall 22 is speaker cover 100, for alarm 96 within alarm system 90, seen in FIG. 2. Additionally, affixed onto bottom wall 30, is extractor housing 32.

As illustrated in FIG. 2, present invention 10 also includes ozone-producing assembly 60. Ozone producing assembly 60 is defined as ultraviolet lamp 62 and ozone generator 64. Lamp 62, as an ultraviolet lamp, is known to neutralize bacteria and germs, without detrimental side effects to the user. Ultraviolet rays themselves do not pass through the covering of contents C, but do produce a frequency that neutralizes bacteria and germs within housing assembly 20. Frequencies other than those known as ultra violet can also be used if effective against bacteria and germs being suspected. As represented, lamp 62 is mounted on the interior surface of wall 22. Ozone generator 64 is affixed adjacent to lamp 62 and produces ozone to complement lamp 62. Lamp 62 and ozone generator 64 are connected to electrical conduit 48. Electrical conduit 48 is connected to each of the electrical components of instant invention 10, namely, power source 54, indicator assembly 40, ozone producing assembly 60, extractor assembly 70 and alarm system 90.

Partially housed within housing assembly 20 is extraction assembly 70. Tube 72 of extraction assembly 70 is generally cylindrically elongated and affixed onto bottom wall 30.

Figure 3:
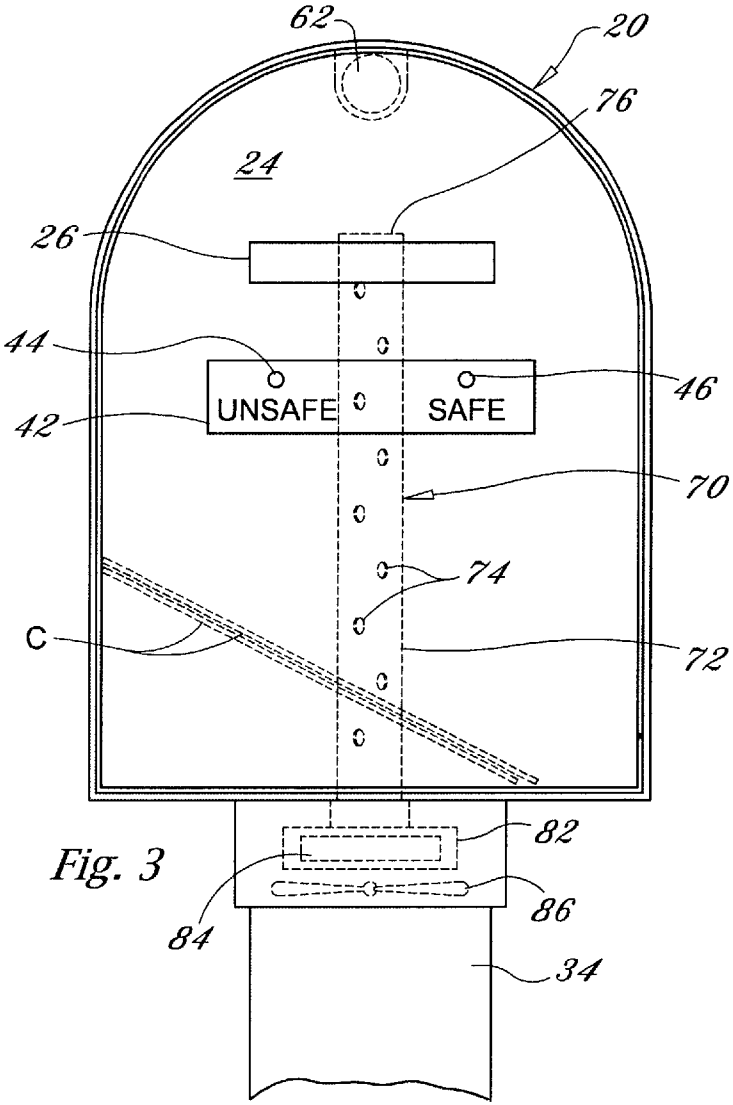
FIG. 3 represents an isometric front view of the instant invention.

As seen in FIG. 3, housing assembly 20 may fit contents C of various shapes and sizes without blocking holes 74 of tube 72.

Figure 4:
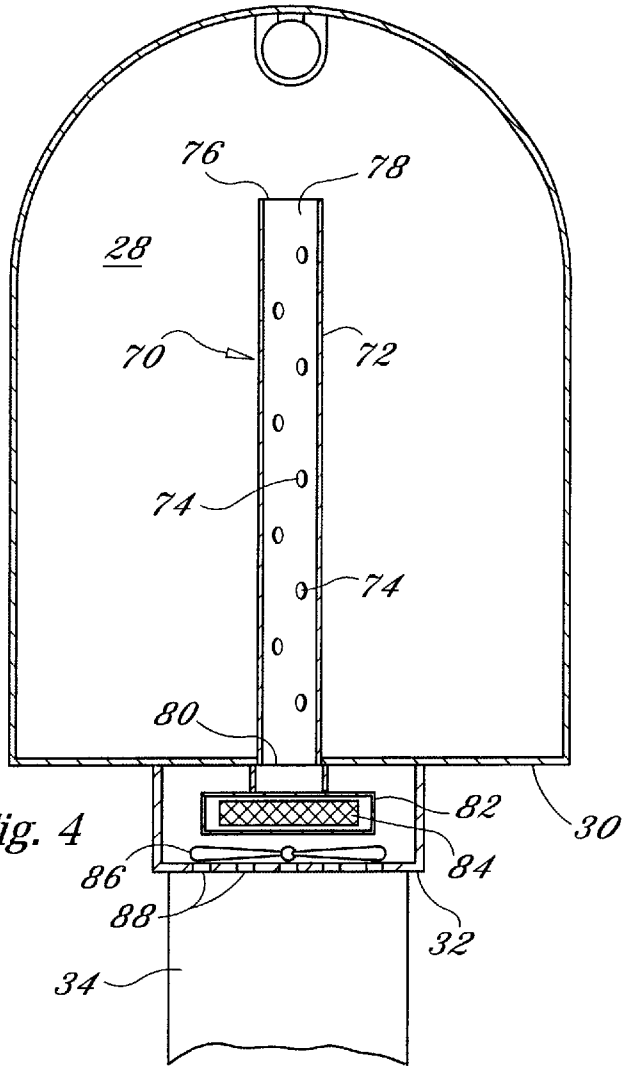
FIG. 4 illustrates a cut view of the instant invention taken along the line 4—4 of FIG. 1.

As seen in FIG. 4, extractor assembly 70 comprises tube 72 having a plurality of holes 74, top end 76, and bottom end 80. At top end 76, tube 72 also has hole 78. Bottom end 80 is securely affixed to bottom wall 30. As best seen in the illustrated figure, extractor-housing 32 is affixed onto the exterior surface of bottom wall 30. Extractor housing 32 is generally rectangular and houses filter housing 82, with its respective filter 84, and fan 86. Bottom wall 30 has a hole to receive bottom end 80, and bottom end 80 is secured onto a receiving end of filter housing 82. Filter 84 is designed to collect all of the neutralized bacteria and biological germs from housing assembly 20.

Figure 5:
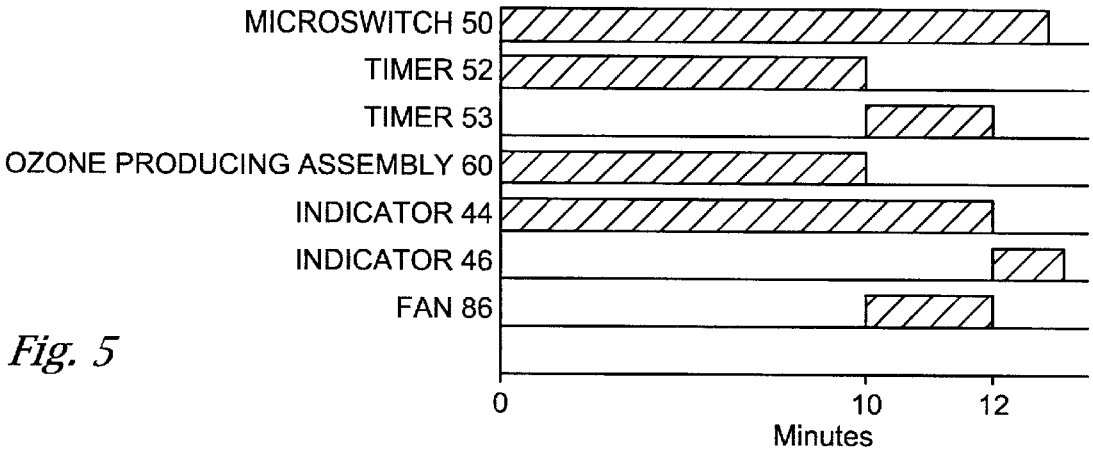
FIG. 5 shows a block chart of approximated operating times for selected electrical components.
Figure 6:
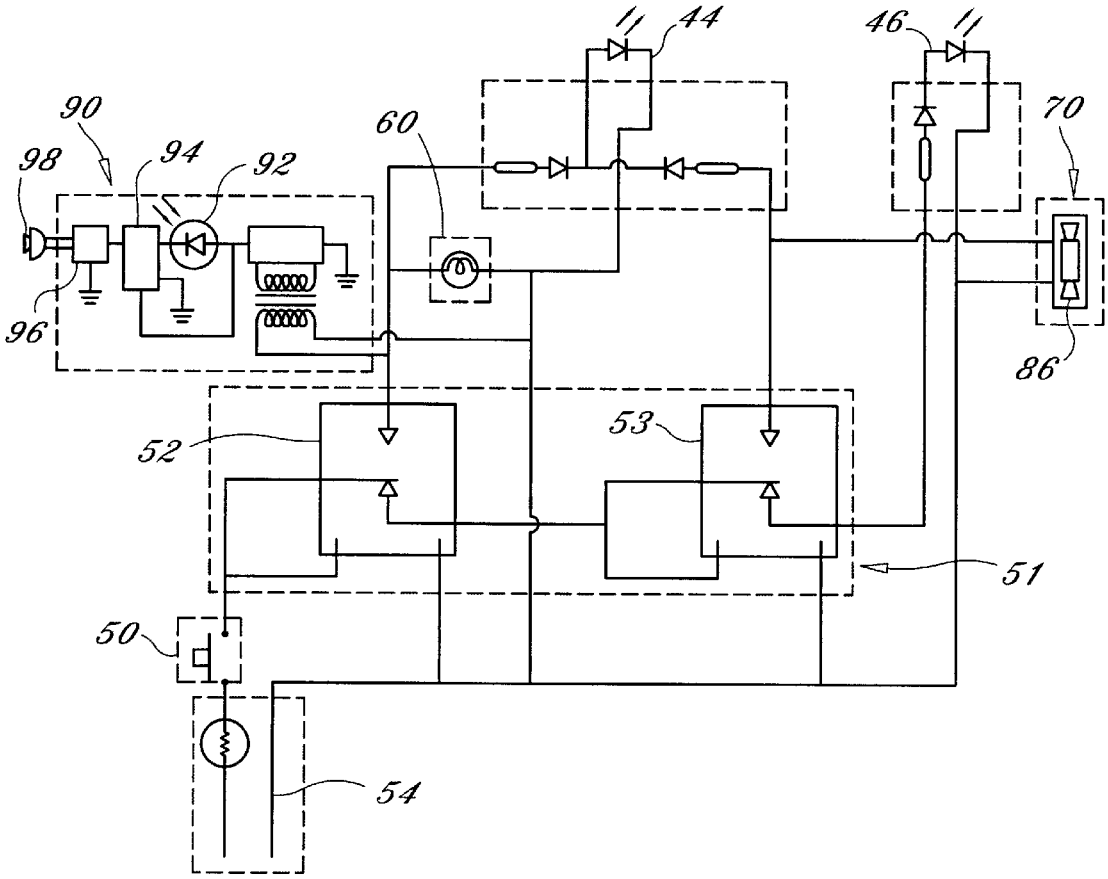
FIG. 6 shows a schematic block diagram of the electrical circuit of the present invention.

In operation, contaminated mail pieces, contents C, are processed and result bacteria-free, without risk to the user and others. To operate instant invention 10, as illustrated in FIGS. 5 and 6, door 24 is opened to place contents C within housing assembly 20. Micro-switch 50 is mechanically triggered with the opening of door 24, activating timer assembly 51. For a first predetermined amount of time, timer 52 times ozone producing assembly 60, and more specifically lamp 62 and ozone generator 64 operate to sterilize bacteria and other biological germs present on and in contents C. During this first predetermined amount of time, indicator 44 illuminates, notifying the user that it is "unsafe" to open door 24.

When the first predetermined amount of time expires for timer 52, extractor assembly 70 operates for a second predetermined time with timer 53. Specifically, fan 86 operates to circulate the sterilized bacteria and other biological germs out of housing assembly 20. Air from within housing 20 circulates through holes 78 and 74, through filter 84, and circulates out of instant invention 10 through holes 88, seen in FIG. 4, at the base of extractor housing 32. Once the second predetermined amount of time expires, the operation is complete and indicator 46 illuminates, notifying the user that the bacteria and biological germs have been sterilized and rid of.

FIG. 5 represents approximated times for selected electrical components to operate. The times are defined in minutes. Other embodiments of the instant invention may utilize shorter or longer operating times depending on the effectiveness of the electrical components, in particular ozone producing assembly 60 and fan 86.

Alarm system 90 notifies the user when ozone-producing assembly 60 is not functioning. Specifically, when ozone-producing assembly 60 malfunctions, photocell diode 92 and relay 94 are activated to set off alarm 96. Alarm 96 in turn sends a signal to speaker 98, which sounds off to notify the user of the malfunction.

As shown in the preferred embodiment, power source 54, an electrical cord, may be plugged into a conventional wall outlet. Alternatively, power source 54 may be of replaceable batteries or rechargeable through solar power or with recharging units.

Matter that is mailed, such as contents C, may be correspondence, letters, packages, parcels, and the like, typically mailed and placed in mailboxes. In an alternate embodiment, housing assembly 20 may be the shape of other mailboxes, including mailboxes such as those of the United States Postal Service.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mailbox for contents, comprising:

A) a housing assembly having an access door and first, second, and third walls, said access door and said first wall are in a parallel and spaced-apart relationship with respect to said second and third walls, said second wall having a through-hole, said housing assembly being substantially hollow;

B) an indicator assembly having electronic means to notify a user when said contents are free of bacteria and biological germs while in said housing assembly;

C) ultra violet and ozone generating means for radiating said contents within said housing assembly with rays and ozone, to effectively sterilize said bacteria and biological germs existing within said housing assembly; and D) circulation means to circulate sterilized bacteria and biological germs out of said housing assembly, wherein said circulation means comprises an extractor assembly having an air intake, filtering system and extraction fan, said air intake with cooperative dimensions to mount within said housing assembly onto said through-hole, said filtering system retaining said sterilized bacteria and biological germs when said extraction fan is operating.

2. The mailbox for contents set forth in claim 1, wherein said electronic means comprises at least one visual indicator that illuminates to notify said user when said bacteria and biological germs have been sterilized for a predetermined time and rid from said contents.

3. The mailbox for contents set forth in claim 2, wherein said bacteria and biological germs are anthrax.

4. A mailbox for contents, comprising:

A) a housing assembly having an access door and first, second, and third walls, said access door and said first wall are in a parallel and spaced-apart relationship with respect to said second and third walls, said second wall having a through-hole, said housing assembly being substantially hollow;

B) an indicator assembly having electronic means to notify a user when bacteria and biological germs have been sterilized for a predetermined time and rid of from said contents, wherein said electronic means comprises at least one visual indicator that illuminates to notify said user when said bacteria and biological germs have been sterilized for said predetermined time and rid from said contents;

C) ultra violet and ozone generating means for radiating said contents within said housing assembly with rays and ozone, to effectively sterilize said bacteria and biological germs existing within said housing assembly; and D) circulation means to circulate sterilized bacteria and biological germs out of said housing assembly, wherein said circulation means comprises an extractor assembly having an air intake, filtering system and extraction fan, said air intake with cooperative dimensions to mount within said housing assembly onto said through-hole, said filtering system retaining said sterilized bacteria and biological germs when said extraction fan is operating.

5. The mailbox for contents set forth in claim 4, wherein said bacteria and biological germs are anthrax.

6. The mailbox for contents set forth in claim 5, wherein said housing assembly is elevated by a mounting post.

* * * * *